US010889468B2

(12) United States Patent
Hu

(10) Patent No.: US 10,889,468 B2
(45) Date of Patent: Jan. 12, 2021

(54) ELECTRONICS SAFETY ACTUATOR

(71) Applicant: Otis Elevator Company, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 637 days.

(21) Appl. No.: 15/377,497

(22) Filed: Dec. 13, 2016

(65) Prior Publication Data

US 2018/0162694 A1 Jun. 14, 2018

(51) Int. Cl.

| | |
|---|---|
| ***B66B 5/22*** | (2006.01) |
| ***B66B 5/02*** | (2006.01) |
| ***B66B 5/18*** | (2006.01) |
| ***B66B 9/00*** | (2006.01) |

(52) U.S. Cl.

CPC ..... *B66B 5/22* (2013.01); *B66B 5/02* (2013.01); *B66B 5/18* (2013.01); *B66B 9/00* (2013.01)

(58) Field of Classification Search

CPC ..... B66B 5/22; B66B 5/18; B66B 5/02

See application file for complete search history.

(56) References Cited

U.S. PATENT DOCUMENTS

| | | | |
|---|---|---|---|
| 5,366,044 | A | 11/1994 | Jamieson et al. |
| 5,791,442 | A | 8/1998 | Arnold |
| 5,873,434 | A | 2/1999 | Sugita |
| 6,161,653 | A | 12/2000 | Skalski et al. |
| 6,722,477 | B1 | 4/2004 | Wolfsteiner et al. |
| 7,575,099 | B2 | 8/2009 | Oh et al. |
| 7,753,176 | B2 | 7/2010 | Kigawa et al. |
| 7,849,972 | B2 | 12/2010 | Higashinaka |
| 8,136,637 | B2 | 3/2012 | Coquerelle et al. |
| 8,365,870 | B2 | 2/2013 | Sirigu et al. |
| 8,939,262 | B2 | 1/2015 | Schienda et al. |
| 8,991,561 | B2 | 3/2015 | Husmann |
| 9,027,714 | B2 | 5/2015 | Husmann et al. |
| 9,120,643 | B2 | 9/2015 | Meierhans et al. |
| 9,169,104 | B2 | 10/2015 | Legeret et al. |
| 9,457,989 | B2 | 10/2016 | Meierhans et al. |

(Continued)

FOREIGN PATENT DOCUMENTS

| | | | |
|---|---|---|---|
| CN | 1608970 | A | 4/2005 |
| CN | 2717905 | Y | 8/2005 |

(Continued)

OTHER PUBLICATIONS

Machine translation of DE 10 2013 111 385.*

(Continued)

*Primary Examiner* — Diem M Tran

(74) *Attorney, Agent, or Firm* — Cantor Colburn LLP

(57) ABSTRACT

A selectively operable magnetic braking system having a safety brake adapted to arrest movement when moved from a non-braking state into a braking state, a magnetic brake pad configured to move between an engaging position and a non-engaging position, the magnetic brake pad, when in the engaging position, moving an engaging mechanism and thereby the safety brake from the non-braking state into the braking state, and an electromagnetic actuator configured to move the magnetic brake pad from the non-engaging position to an engaging position.

18 Claims, 8 Drawing Sheets

(56) References Cited

U.S. PATENT DOCUMENTS

| | | | |
|---|---|---|---|
| 2011/0088983 | A1 | 4/2011 | Sirigu et al. |
| 2015/0259175 | A1 | 9/2015 | West et al. |
| 2016/0102718 | A1 | 4/2016 | Polack et al. |
| 2016/0236904 | A1 | 8/2016 | Witczak et al. |
| 2016/0280511 | A1 | 9/2016 | Anderson et al. |

FOREIGN PATENT DOCUMENTS

| | | | |
|---|---|---|---|
| CN | 1784351 | A | 6/2006 |
| CN | 101428722 | A | 5/2009 |
| CN | 201295925 | Y | 8/2009 |
| CN | 101759076 | A | 6/2010 |
| CN | 101920880 | A | 12/2010 |
| CN | 102000994 | A | 4/2011 |
| CN | 102344070 | A | 2/2012 |
| CN | 203158966 | U | 8/2013 |
| CN | 103420242 | A | 12/2013 |
| CN | 103482448 | A | 1/2014 |
| CN | 103517864 | A | 1/2014 |
| CN | 103648953 | A | 3/2014 |
| CN | 105398908 | A | 3/2016 |
| CN | 205772611 | U | 12/2016 |
| DE | 102013111385 | A1 | 4/2015 |
| EP | 0812796 | A1 | 12/1997 |
| EP | 2920100 | A1 | 9/2015 |
| WO | 2011021064 | A1 | 2/2011 |
| WO | 2014077813 | A1 | 5/2014 |
| WO | 2015191695 | A1 | 12/2015 |
| WO | 2015191696 | A1 | 12/2015 |
| WO | 2016022749 | A1 | 2/2016 |
| WO | 2016045932 | A1 | 3/2016 |
| WO | 2016045934 | A1 | 3/2016 |
| WO | 2016096320 | A1 | 6/2016 |
| WO | 2016139243 | A1 | 9/2016 |

OTHER PUBLICATIONS

English Abstract for CN1608970A—Apr. 27, 2005; 1 pg.
English Abstract for EP2920100A1—Sep. 23, 2015; 1 pg.
English Abstract for WO2016045932A1—Mar. 31, 2016; 1 pg.
English Abstract for WO2016045934A1—Mar. 31, 2016; 1 pg.
English Abstract for WO2016096320A1—Jun. 23, 2016; 2 pgs.
English Abstract for WO2016139243—Sep. 9. 2016; 1 pg.
European Search Report for Application No. 17206784.5-1017; dated Jun. 1, 2018; 9 pgs.
Chinese Office Action for application CN 2017113180383, dated Apr. 3, 2020, 19 pages.

* cited by examiner

ELECTRONICS SAFETY ACTUATOR

TECHNICAL FIELD OF THE DISCLOSED EMBODIMENTS

The present disclosure is generally related to braking and/or safety systems and, more specifically, an electronic safety actuator for an elevator.

BACKGROUND OF THE DISCLOSED EMBODIMENTS

Some machines, such as an elevator system, include a safety system to stop the machine when it rotates at excessive speeds or the elevator cab travels at excessive speeds. Conventional safety systems may include machine single braking surface for slowing the over rotation or over speed condition. Machines that are large and/or operate at elevate speeds may require additional braking surfaces to handle the additional load and speed while operating reliably. However, when a second, or even further additional, braking surfaces are added, it becomes important to synchronize the braking surfacing to improve durability, braking performance and other overall performance factors within the system. There is therefore a need for a more robust safety system for safety systems in which more than one braking surface is employed.

BRIEF SUMMARY OF THE EMBODIMENTS

In an embodiment described herein is a braking device for an elevator system including a car and a guide rail, including a safety brake disposed on the car and adapted to be wedged against the guide rail when moved from a non-braking state into a braking state and an engagement mechanism having an engaging position and a nonengaging position, the engagement mechanism operably coupled to the safety brake and configured to move the safety brake between the non-braking state and braking state when the engagement mechanism moves between the nonengaging position and the engaging position. The braking device also includes a first magnetic brake pad and a second magnetic brake pad, the first magnetic brake pad and the second magnetic brake pad disposed in opposing directions adjacent to the guide rail and configured to move between the non-engaging position and the engaging position, the first magnetic brake pad and the second magnetic brake pad operably coupled to the engagement mechanism, wherein the engagement mechanism is configured such that movement of the first magnetic brake pads into the engaging position causes movement of the second magnetic brake pad into the engaging position.

In addition to one or more of the features described above, or as an alternative, further embodiments may include a first electromagnetic actuator and a second electromagnetic actuator, wherein the first electromagnetic actuator is configured to electromagnetically move the first magnetic brake pad between the non-engaging position and engaging position and the second electromagnetic actuator configured to electromagnetically move the second magnetic brake pad between the non-engaging position and engaging position.

In addition to one or more of the features described above, or as an alternative, further embodiments may include that at least one of the first electromagnetic actuator and the second electromagnetic actuator is in operable communication with a controller, the controller configured to control the electricity supplied to the at least one of the first electromagnetic actuator and the second electromagnetic actuator.

In addition to one or more of the features described above, or as an alternative, further embodiments may include that the at least one of the first electromagnetic actuator and the second electromagnetic actuator is configured to move the first magnetic brake pad and second magnetic brake pad into the engaging position upon at least one of a reduction, an elimination, and an application of the electricity supplied by the controller.

In addition to one or more of the features described above, or as an alternative, further embodiments may include that the at least one of the first electromagnetic actuator and the second electromagnetic actuator is configured to return the first magnetic brake pad and the second magnetic brake pad into the non-engaging position upon reversal of the electricity supplied by the controller.

In addition to one or more of the features described above, or as an alternative, further embodiments may include that the elevator car is moved to align the first magnetic brake pad and the second magnetic brake pad with the first electromagnetic actuator and second electromagnetic actuator respectively to reset the safety brake from the braking state to the non-braking state, wherein the engagement mechanism is moved between the engaging position to the non-engaging position.

In addition to one or more of the features described above, or as an alternative, further embodiments may include that the engagement mechanism is configured to synchronize the movement of the first magnetic brake pad and the second magnetic brake pad between the non-engaging position and the engaging position.

In addition to one or more of the features described above, or as an alternative, further embodiments may include the engagement mechanism is a four-bar linkage. Moreover, the four-bar linkage may be comprised of four substantially equally sized links operably connected by pivots, wherein two opposing pivots are each attached to at least one of the first magnetic brake pad and the second magnetic brake pad and at least one of a third pivot and fourth pivot pivots are horizontally constrained and operably attached to the safety brake, wherein movement of at least one of the first magnetic brake pad and the second magnetic brake pad from the non-engaging position to the engaging position, and thereby the attached two opposing pivots, operate at least one of the third pivot and the forth pivot to move to cause the safety brake to move from the non-braking state into the braking state.

In addition to one or more of the features described above, or as an alternative, further embodiments may include that the engagement mechanism is a plate. Moreover still, in addition, the plate may be comprised of three collinear pivots with two opposing pivots equidistant from a central pivot, wherein two opposing pivots operating in slots in the plate are each attached to one of the first magnetic brake pad and the second magnetic brake pads respectively, and a third pivot is are horizontally constrained and operably attached to the safety brake, wherein movement of at least one of the first magnetic brake pads and second magnetic brake pad from the non-engaging position to the engaging position, and thereby the attached two opposing pivots, causes plate to rotate and the third pivot to move to cause the safety brake to move from the non-braking state into the braking state.

In another embodiment, described herein is a braking device for an elevator system including a car and a guide rail. The braking device including a safety brake disposed on the car and adapted to be wedged against the guide rail when moved from a non-braking state into a braking state and a magnetic brake pad operably coupled an engagement mechanism and disposed adjacent to the guide rail, the magnetic brake pad configured to move between an non-engaging position and an engaging position, the magnetic brake pad, when in the engaging position, causing the engagement mechanism to move the safety brake from the non-braking state into the braking state.

In addition to one or more of the features described above, or as an alternative, further embodiments may include an electromagnetic actuator, wherein the electromagnetic actuator is configured to hold the magnetic brake pad in the non-engaging position.

In addition to one or more of the features described above, or as an alternative, further embodiments may include that the electromagnetic actuator is in operable communication with a controller, the controller configured to control the electricity supplied to the electromagnetic actuator.

In addition to one or more of the features described above, or as an alternative, further embodiments may include that the electromagnetic actuator is configured to move the magnetic brake pad into the engaging position upon at least one of the application of, the reduction of, and the elimination of electricity supplied by the controller.

In addition to one or more of the features described above, or as an alternative, further embodiments may include that the electromagnetic actuator is configured to return the magnetic brake pad into the non-engaging position upon reversal of the electricity supplied by the controller.

In addition to one or more of the features described above, or as an alternative, further embodiments may include that the elevator car is moved to align the magnetic brake pad with the electromagnetic actuator to reset the safety brake from the braking state to the non-braking state, wherein the engagement mechanism is moved between the engaging position to the non-engaging position.

In addition to one or more of the features described above, or as an alternative, further embodiments may include that the engagement mechanism is configured to ensure the movement of a second magnetic brake pad between a non-engaging position and an engaging position.

In addition to one or more of the features described above, or as an alternative, further embodiments may include that the engagement mechanism is a two-bar linkage.

In yet another embodiment described herein is an elevator system including a hoistway with a guide rail disposed in the hoistway and a car operably coupled to the guide rail by a car frame for upward and downward travel in the hoistway. The elevator system also includes a safety brake disposed on the car and adapted to be wedged against the guide rail when moved from a non-braking state into a braking state, an engagement mechanism operably coupled to the safety brake and configured to move the safety brake between the non-braking state and braking state, and a first magnetic brake pad and a second magnetic brake pad, the first magnetic brake pad and the second magnetic brake pad disposed in opposing directions adjacent to the guide rail and configured to move between the non-engaging position and the engaging position, the first magnetic brake pad and the second magnetic brake pad operably coupled to the engagement mechanism, wherein the engagement mechanism is configured such that movement of the first magnetic brake pads into the engaging position causes movement of the second magnetic brake pad into the engaging position.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE EMBODIMENTS

Figure 1:
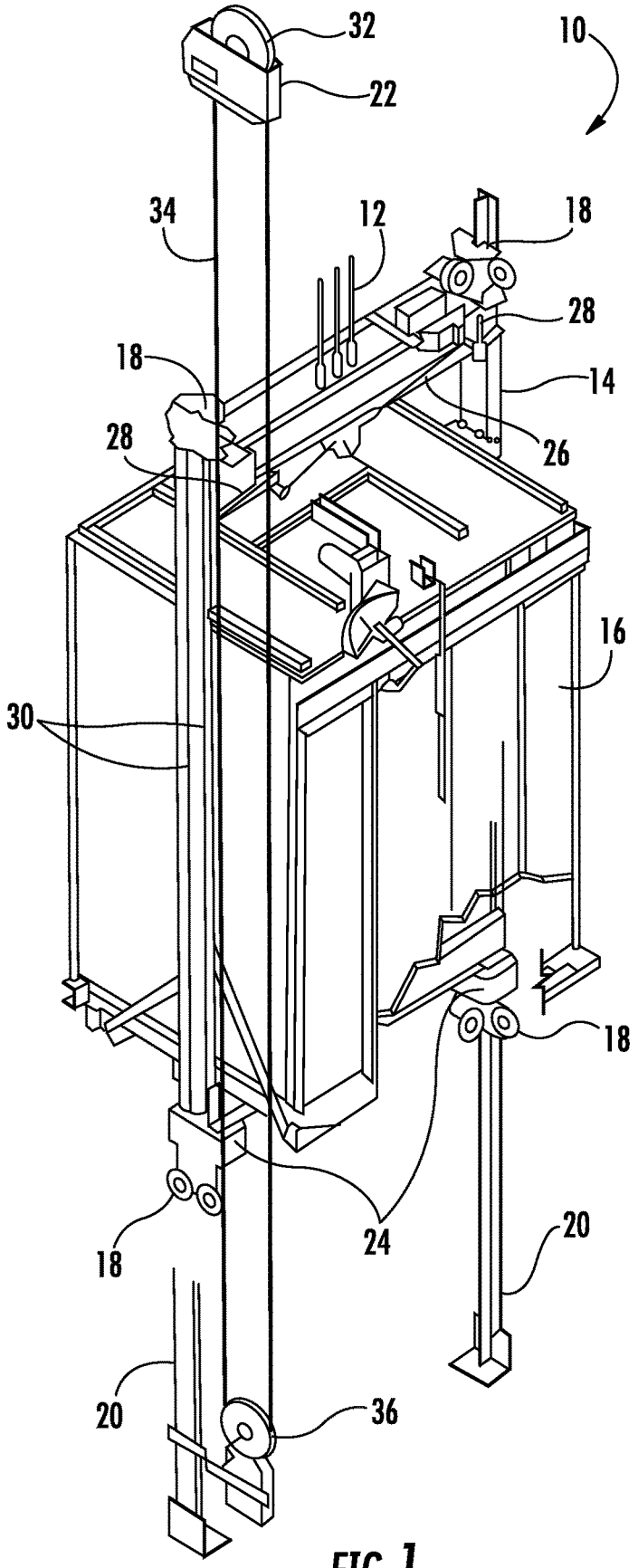
FIG. 1 is a schematic diagram of an elevator system employing a mechanical governor.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

The following description is merely illustrative in nature and is not intended to limit the present disclosure, its application or uses. It should be understood that throughout the drawings, corresponding reference numerals indicate like or corresponding parts and features. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in Figure X may be labeled "Xa" and a similar feature in Figure Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 shows an elevator system, generally indicated at 10. The elevator system 10 includes cables 12, a car frame 14, an elevator car 16, roller guides 18, guide rails 20, a governor 22, safety brake 24, linkages 26, levers 28, and lift rods 30. Governor 22 includes a governor sheave 32, rope loop 34, and a tensioning sheave 36. Cables 12 are connected to car frame 14 and a counterweight (not shown in FIG. 1) inside a hoistway. Elevator car 16, which is attached to car frame 14, moves up and down the hoistway by force transmitted through cables or belts 12 to car frame 14 by an elevator drive (not shown) commonly located in a machine room at the top of the hoistway. Roller guides 18 are attached to car frame 14 to guide the elevator car 16 up and down the hoistway along guide rail 20. Governor sheave 32 is mounted at an upper end of the hoistway. Rope loop 34 is wrapped partially around governor sheave 32 and partially around tensioning sheave 36 (located in this embodiment at a bottom end of the hoistway). Rope loop 34 is also connected to elevator car 16 at lever 28, ensuring that the angular velocity of governor sheave 32 is directly related to the speed of elevator car 16.

In the elevator system 10 shown in FIG. 1, governor 22, an electromechanical brake (not shown) located in the machine room, and the safety brake 24 acts to stop elevator car 16 if it exceeds a set speed as it travels inside the hoistway. If elevator car 16 reaches an over-speed condition, governor 22 is triggered initially to engage a switch, which in turn cuts power to the elevator drive and drops the brake to arrest movement of the drive sheave (not shown) and thereby arrest movement of elevator car 16. If, however, the elevator car 16 continues to experience an over speed condition, governor 22 may then act to trigger the safety brake 24 to arrest movement of elevator car 16. In addition to engaging a switch to drop the brake, governor 22 also releases a clutching device that grips the governor rope 34. Governor rope 34 is connected to the safety brake 24 through mechanical linkages 26, levers 28, and lift rods 30. As elevator car 16 continues its descent unaffected by the brake, governor rope 34, which is now prevented from moving by actuated governor 22, pulls on operating lever 28. Operating lever 28 "sets" the safety brake 24 by moving linkages 26 connected to lift rods 30, which lift rods 30 cause the safety brake 24 to engage guide rails 20 to bring elevator car 16 to a stop.

Mechanical speed governor systems are being replaced in some elevators by electronic systems. Existing electronic safety actuators mainly employ primarily asymmetric safety brake configurations. These devices typically have a single sliding wedge forceably engaging the elevator guide rail 20 and are usually employed for low and mid speed applications. However, for high speed elevator systems, symmetric safety brakes may become necessary. To this end, as described herein is an electronic elevator safety actuation device 40 that is suitable for actuating and resetting symmetric safety brakes 24 that have two sliding wedges to engage the guide rail 20 of the elevator system 10.

Figure 2:
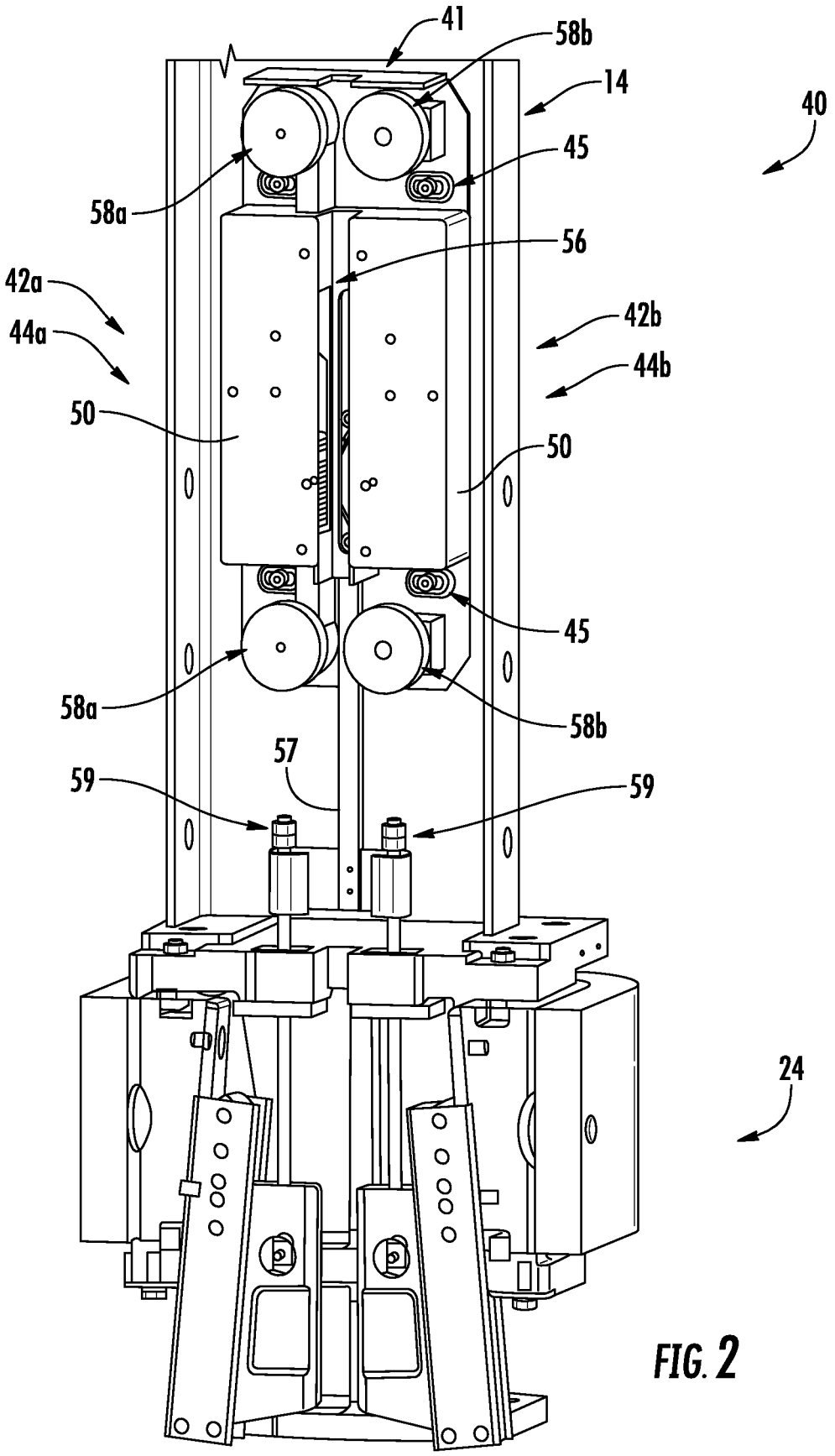
FIG. 2 is a perspective view of an electronic safety actuator and safety brake according to an embodiment of the present disclosure.

FIG. 2 shows an embodiment of an assembly for a safety actuation device 40 affixed to the car frame 14. In an embodiment the safety actuation device 40 includes a mounting plate 41 with the electromagnetic actuators shown generally as 42*a*, 42*b* with magnetic brake pads shown generally as 44*a*, 44*b* affixed to the mounting plate 41 within a housing 50. The mounting plate 41 includes at least one aperture 45 disposed therein for mounting the safety actuation device 40 to the car frame 14. The apertures 45 on the mounting plate 41 and the fasteners fixed on the car frame 14 allow a safety actuation device 40 to be floating horizontally when there is position variation between the elevator car 16 and the guide rail 20, which typically occurs during an elevator normal run as well as when actuating and resetting the safety brake 24. The safety actuation device 40 further includes a channel 56 extending substantially perpendicular from the mounting plate 41, and configured to surround the guide rail 20. The guide rail 20 (not shown) is disposed within the channel 56.

Continuing with FIG. 2, a first roller 58*a* and a second roller 58*b* may be positioned above and/or below the two housings 50 and positioned to each side of the channel 56. The guide rail 20 is disposed within the channel 56 with the first roller 58*a* and the second roller 58*b* engaged with the guide rail 20 to minimize the impact of position variations between the safety actuation device 40 and the guide rail 20. It will therefore be appreciated that the present embodiments include a mounting assembly 40 having at least one guide device, in this instance first roller 58*a* and second roller 58*b* disposed about channel 56, or alternatively at least one guide device affixed to the mounting plate 41 to substantially align the channel 56 of the safety actuation device 40 horizontally with respect to the guide rail 20 to improve the performance of safety actuation and reset due to the minimized position variations, (i.e., front to back) between the safety actuation device 40 and the guide rail 20.

Figure 3A:
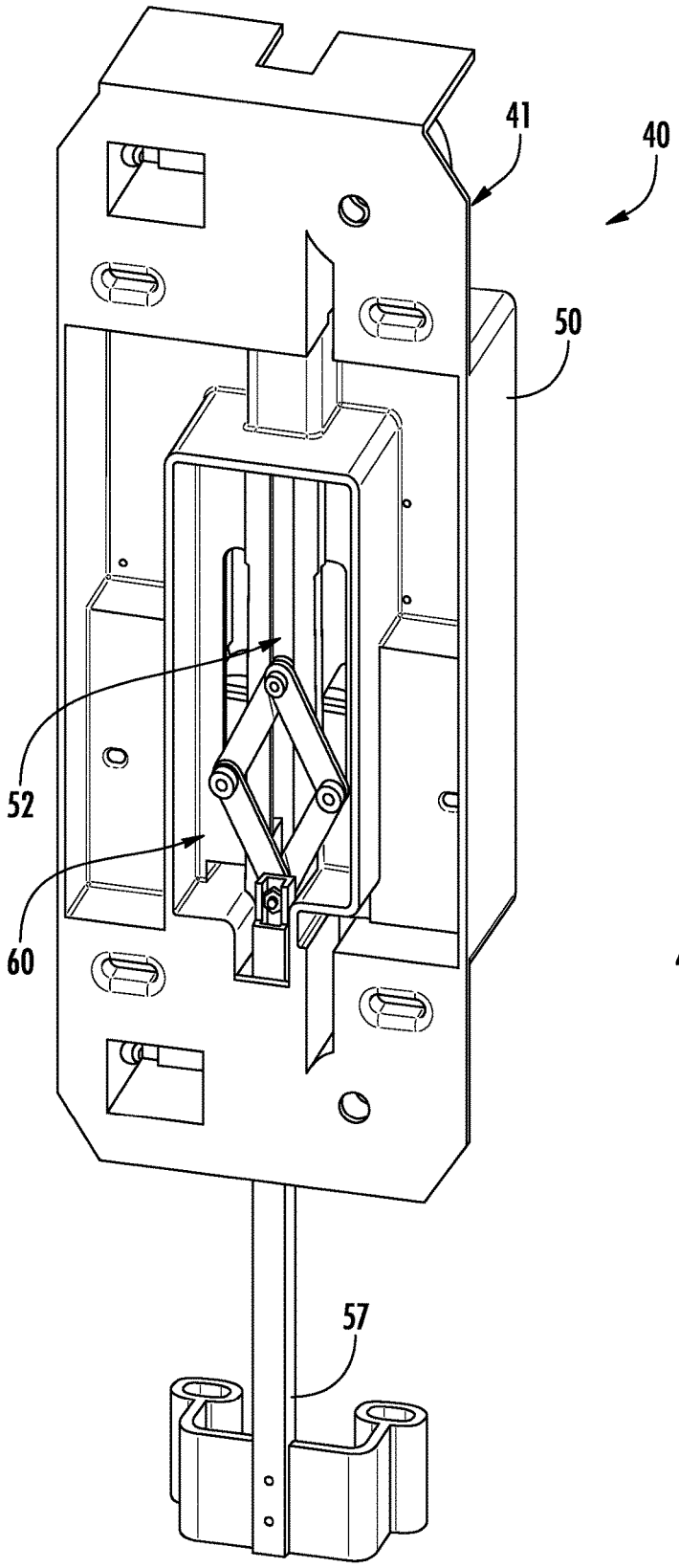
FIG. 3A is a partial perspective view of the electronic safety actuator with an engagement mechanism according to an embodiment of the present disclosure.
Figure 3B:
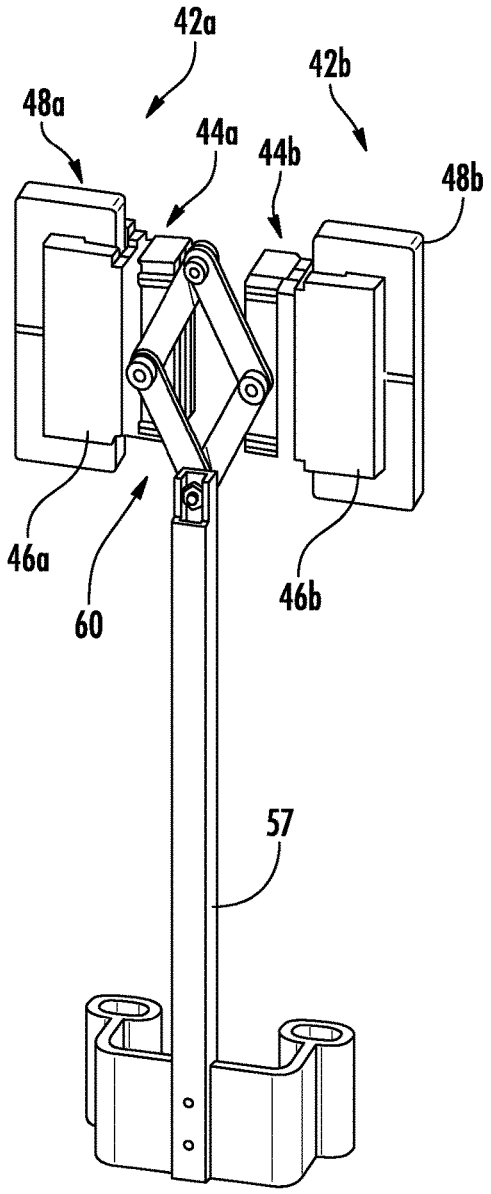
FIG. 3B is a partial view of the electronic safety actuator with an engagement mechanism according to an embodiment of the present disclosure.

Turning now to FIGS. 3A and 3B as well, a partial reverse view of the safety actuation device 40 is provided. The safety actuation device 40 includes, but is not limited to, two electromagnetic actuators 42*a*, 42*b* with magnetic brake pads 44*a* and 44*b* arranged facing on opposite surfaces of the channel 56 and thereby, the guide rail 20. These two magnetic brake pads 44*a*, 44*b* are connected by a engagement mechanism shown generally as 60 that in some embodiments synchronizes magnetic brake pads' 44*a*, 44*b* horizontal movement towards the guide rail 20 (not shown) and moves vertically (in the axis of the guide rail) along the housing 50 of the safety actuation device 40. In addition, the engagement mechanism 60 increases actuation and reset reliability, by ensuring either electromagnetic actuator 42 can actuate or reset both magnetic brake pads 44*a*, 44*b* if needed in case the other electromagnetic actuator 42*a*, 42*b* encounters a failure. A linkage 57 is used to connect the engagement mechanism 60 and a pair of safety lift rods 59 (FIG. 2) used to physically engage the safety brake 24. As a result, the safety brake 24 can be actuated and reset reliably through actuation of the engagement mechanism 60 and linkage 57. Advantageously, in the embodiments described, any synchronization errors between the two electromagnetic actuators 42*a*, 42*b*, magnetic brake pads 44*a* and 44*b* are also minimized as will be described further herein.

Continuing with FIGS. 3A and 3B, an embodiment of a safety actuation device 40 in a non-engaging position is depicted. The electromagnetic actuator 42*a*, 42*b* includes a coil 48*a*, 48*b* and a core 46*a*, 46*b* disposed within the housing 50 with magnetic brake pads 44*a* and 44*b* magnetically attached/associated with each. A controller (not shown) is in electrical communication with each electromagnetic actuator 42*a*, 42*b* and is configured to control a supply of electricity to the electromagnetic actuator 42*a*, 42*b*. In the embodiment shown, the core 46*a*, 46*b* of electromagnetic actuator 42*a*, 42*b* provides a means for magnetically holding the magnetic brake pads 44*a* and 44*b* in the default, non-engaged position against the electromagnetic actuator 42*a*, 42*b*. In operation if required, the controller is configured to generate a current that creates an electromagnetic force in the electromagnetic actuator 42*a*, and 42*b* to overcome the magnetic holding force between the magnetic brake pads 44*a* and 44*b* and the core 46*a*, 46*b* of the electromagnetic actuator 42*a*, 42*b*. Thereby, under selected conditions the electromagnetic actuator 42*a*, 42*b* creates a repulsive force between each electromagnetic actuator 42*a*, 42*b* and the respective magnetic brake pads 44*a* and 44*b*. For example, in operation upon the identification of an over speed condition and a desire to engage the safety brake 24, a current is applied to the electromagnetic actuators 42*a*, 42*b*. With a reduction of the hold power and/or generation of a repulsive force, the electromagnetic actuator 42*a*, 42*b* is configured to release the respective magnetic brake pads 44*a*, 44*b*. As a result, the magnetic brake pads 44*a*, 44*b* are propelled into the channel 56 towards the guide rail 20 into a rail-engaging position and the magnetic brake pads 44*a*, 44*b* magnetically attach to the guide rail 20. The magnetic brake pads 44*a*, 44*b* are operably coupled to the safety brake 24 through engagement mechanism 60 and via linkage 57 and rod 59. The magnetic brake pads 44*a*, 44*b*, once magnetically attached to the guide rail 20, pulls the safety brake 24 in an upward direction due to the relative upward movement of the magnetic brake pads 44*a*, 44*b* relative to the descending elevator car 16. The safety brake 24 engages the guide rail 20 to arrest the motion of the elevator car 16.

In another embodiment, if operation of the safety brake is required, the controller is configured to reduce or eliminate the holding force between the magnetic brake pads 44*a* and 44*b* and the electromagnetic actuator 42*a*, 42*b* by reducing the amount of electrical energy supplied to the electromagnetic actuator 42*a*, 42*b* under selected conditions and/or applying electricity to create a repulsive force between each electromagnetic actuator 42*a*, 42*b* and the respective magnetic brake pads 44*a* and 44*b*. It will be appreciated that while the engagement and disengagement of the safety actuation device 40 is described with respect to employing electromagnetic actuators 42*a* and 42*b*, other forms of actuation are possible and envisioned. For example, a mechanical mechanism such as springs, latches, control arms, pneumatics and the like could be used to move the magnetic brake pads 44*a*, 44*b* between the nonengaging and engaging positions. In particular, for example a spring with a release mechanism could be used to propel the magnetic brake pads 44*a*, 44*b* from the nonengaging position, to an engaging position where they would adhere to the guide rail 20.

Figure 4A:
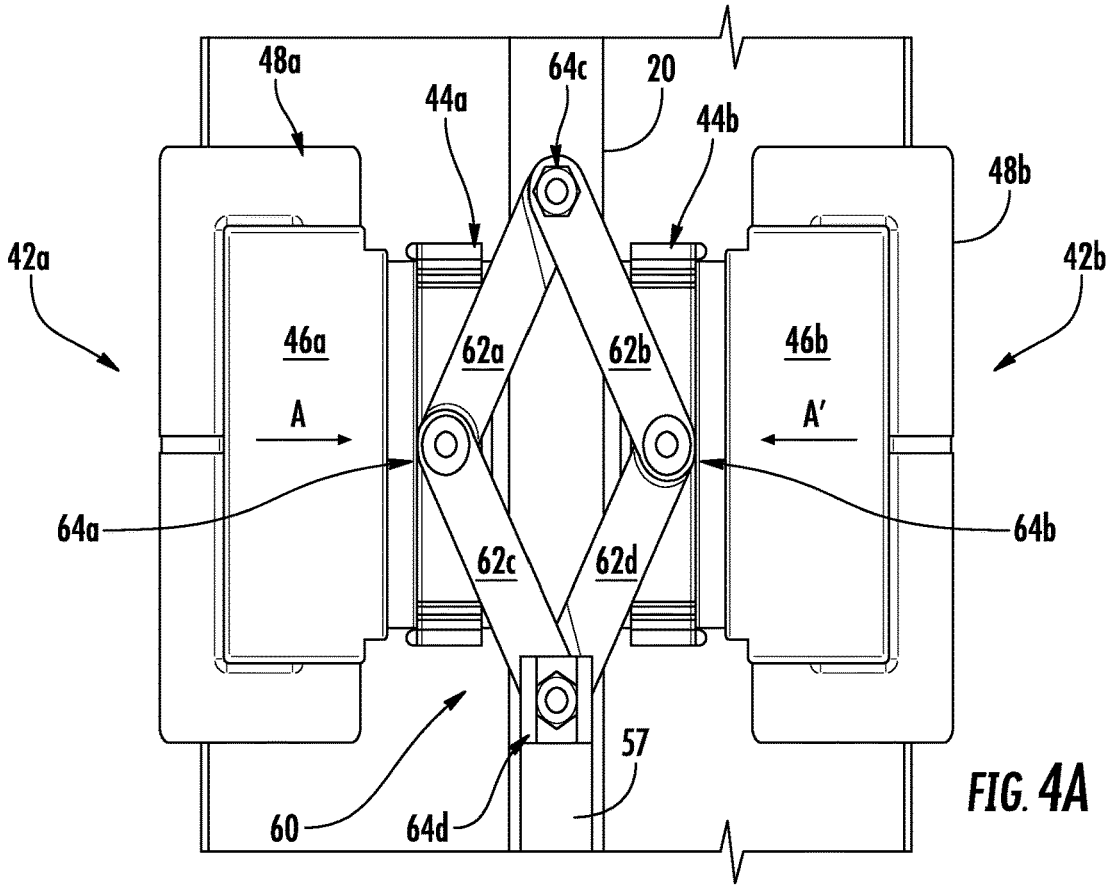
FIG. 4A is an expanded partial view of the electronic safety actuator with engagement mechanism in a non-engaging position according to an embodiment of the present disclosure.
Figure 4B:
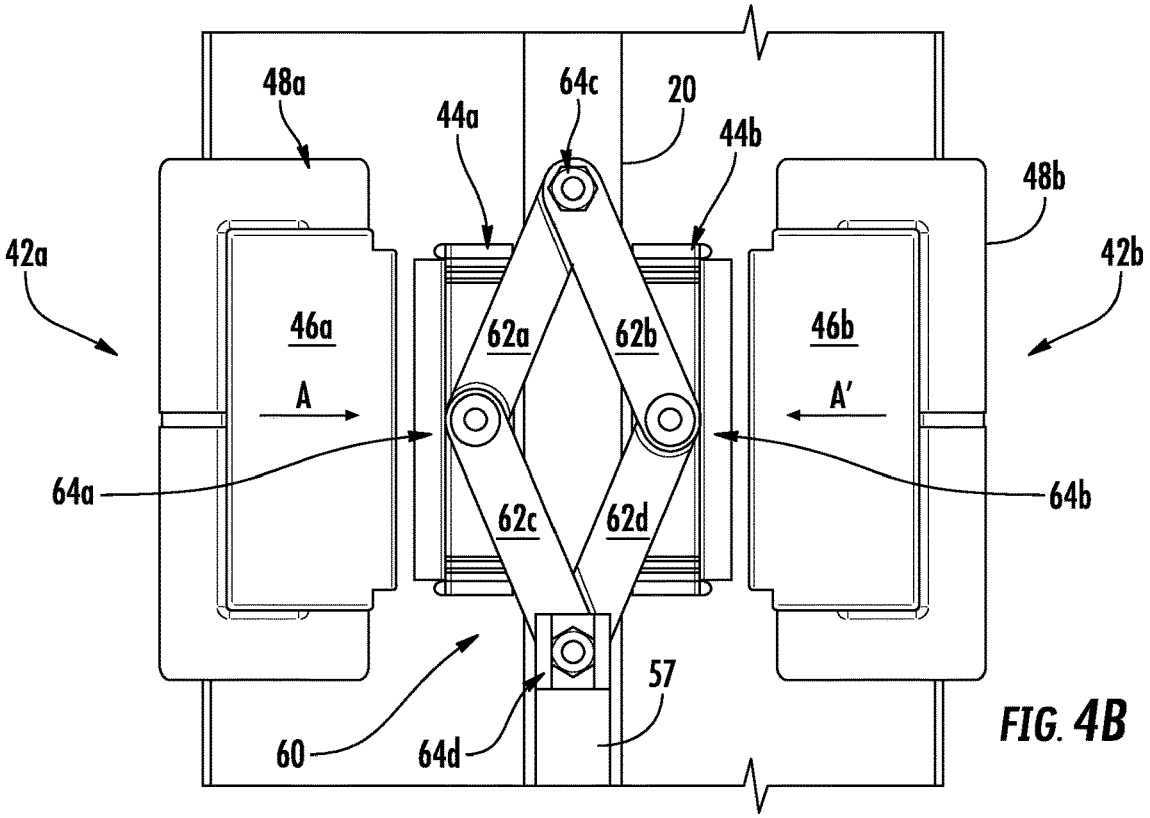
FIG. 4B is an expanded partial view of the electronic safety actuator with engagement mechanism in an engaging position according to an embodiment of the present disclosure.

Continuing with FIGS. 3A and 3B and turning now to FIGS. 4A and 4B as well for further details on the operation of the engagement mechanism 60 of the safety actuation device 40. FIG. 4A depicts the electromagnetic actuator(s) 42*a*, 42*b* and magnetic brake pads 44*a*, 44*b* in a default or non-engaged position, while FIG. 4B depicts the electromagnetic actuator(s) 42*a*, 42*b* and magnetic brake pads 44*a*, 44*b* in an engaged position attached to the guide rail 20. In an embodiment the engagement mechanism 60 is comprised of four linkages 62*a*-62*d* with four pivots 64*a*-64*d*. In an embodiment, all four linkages 62*a*-62*d* are the same arranged in a four-bar linkage, each having two ends attached to a pivot 64*a*-64*d*. The linkage 62*a* at one end is pivotally attached with pivot 64*c* to one end of linkage 62*b*. The linkage 62*b* at its other end is pivotally attached with pivot 64*b* to one end of linkage 62*d*. The linkage 62*d* at its other end is pivotally attached with pivot 64*d* to one end of linkage 62*c*. Finally, the linkage 62*c* at its other end is pivotally attached with pivot 64*a* to the other end of linkage 62*a*. The pivots 64*a* and 64*b* are each also pivotally attached to the magnetic brake pads 44*a* and 44*b* respectively. Likewise the pivots 64*c* and 64*d* ride in a slot 52 or are otherwise constrained in the housing 50 so that any horizontal motion is constrained (but vertical motion is not). Finally, the pivot 64*d* is pivotally attached to the linkage 57.

In operation, when the electromagnetic actuator(s) 42*a*, 42*b* are commanded to actuate the safety brake 24, the magnetic brake pads 44*a* and 44*b* move horizontally toward the guide rail 20 in the direction A-A' as depicted, and in turn magnetically attach to the guide rail 20. As the magnetic brake pads 44*a* and 44*b* move, the pivot points 64*a* and 64*b* also move horizontally toward the guide rail 20. This motion is transferred through the linkages 62*a*-62*d* causing pivots 64*c* and 64*d* to move in opposite directions vertically in slot 52 with pivot 64*c* moving vertically upward relative to the pivots 64*a* and 64*b*, while the pivot 64*d* moving vertically downward relative to the pivots 64*a* and 64*b*. The attachment of the magnetic brake pads 44*a* and 44*b* to the guide rail 20 results in the slowing of the magnetic brake pads 44*a* and 44*b* on the guide rail 20 and through the linkages 62*a*-*d* and pivots 64*a*-*d* pulling the linkage 57 and rod 59 relative to motion of the elevator car 16 and thereby engaging the safety brake 24.

Figure 5:
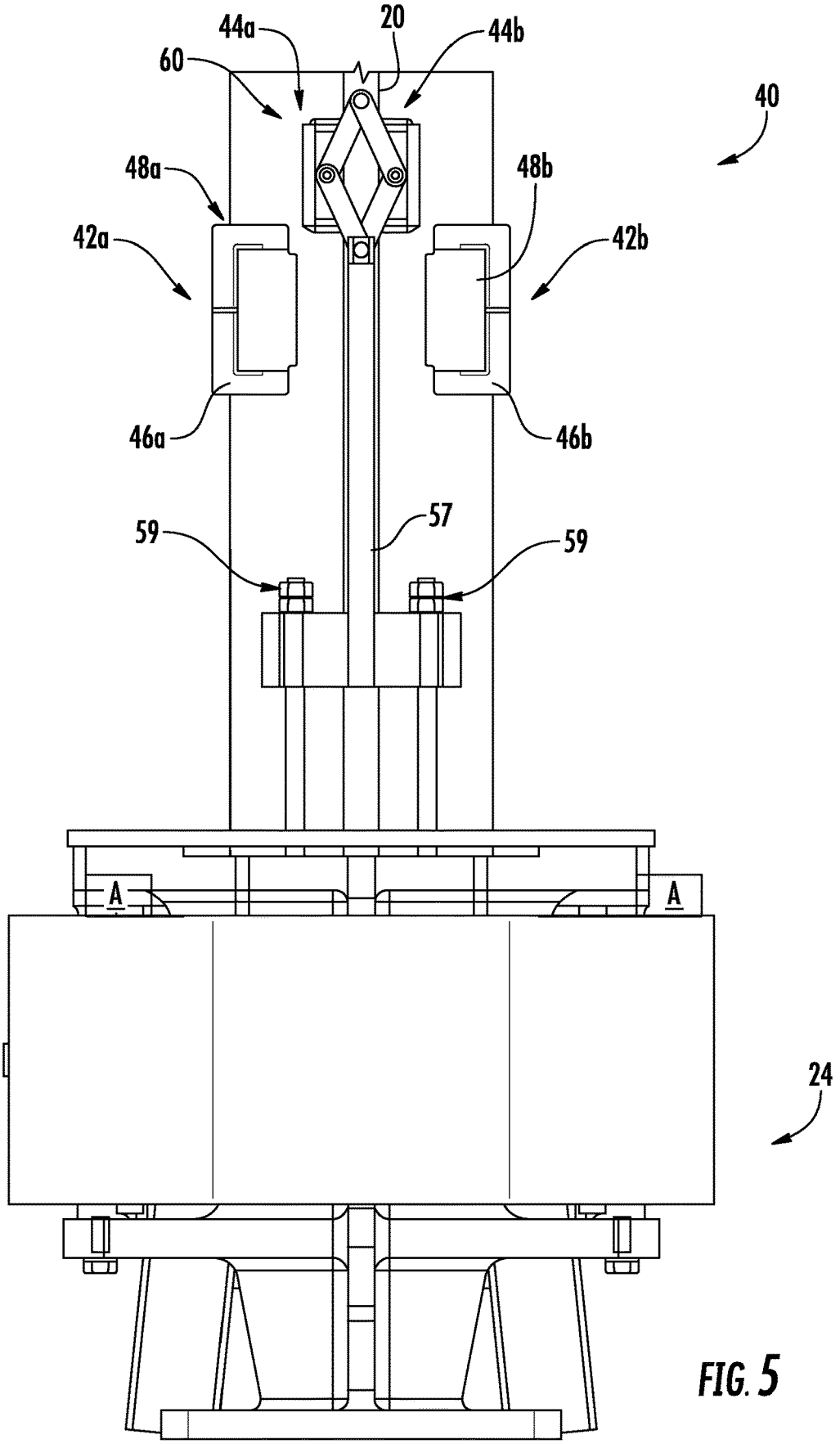
FIG. 5 is a view of an electronic safety actuator and safety brake in an engaged position according to an embodiment of the present disclosure.

FIG. 5 depicts the safety actuation device 40 and safety in the engaged positon with the magnetic brake pads 44*a* and 44*b* magnetically attached to the guide rail 20 and displaced from the electromagnetic actuators 42*a*, 42*b*. In this view it will be appreciated that the magnetic brake pads 44*a* and 44*b* are magnetically attached to the guide rail 20 the safety brake 24 is also engaged to the guide rail 20 and the elevator car 16 has been stopped.

To reset the safety brake 24 and safety actuation device 40 after the safety brake 24 has been engaged, the elevator car 16 is moved upward to align the electromagnetic actuators 42*a*, 42*b* with the magnetic brake pads 44*a* and 44*b*. Once aligned, electrical current is applied to each electromagnetic actuator 42*a*, 42*b* in the opposite direction (opposite to that used to engage) to create an attractive force between the magnetic brake pads 44*a* and 44*b* and the respective electromagnetic actuator 42*a*, 42*b* overcoming the magnetic attraction of the magnetic brake pads 44*a* and 44*b* to the guide rail 20. Advantageously, it will be appreciated that if one electromagnetic actuator is inoperable, the engagement mechanism 60 employing the four linkages 62*a*-62*d* and pivots 64*a*-64*d* to facilitate both magnetic brake pads 44*a* and 44*b* being lifted off the guide rail 20. In particular, if, when the electromagnetic actuator 42*b* in this example, on the right, is commanded to reset, the magnetic brake pad 44*b* moves horizontally away from the guide rail 20 opposite direction A'. As the magnetic brake pad 44*b* moves, the pivot point 64*b* also moves horizontally away from the guide rail 20. This motion is transferred through the linkages 62*a*-62*d* causing pivots 64*c* and 64*d* to move toward each other vertically with pivot 64*c* moving vertically downward relative to the pivots 64*a* and 64*b*, while the pivot 64*d* is moving vertically upward relative to the pivots 64*a* and 64*b*. The vertical motion of pivots 64*c* and 64*d* through the linkages 62*a* and 62*c* will force the motion of pivot 64*a* to the left away from the guide rail 20. The detachment of the magnetic brake pads 44*a* and 44*b* from the guide rail 20 and reattachment to the respective electromagnetic actuator 42*a*, 42*b* results in the magnetic brake pads 44*a* and 44*b* being returned to the default position and once again ready for reengagement.

In another embodiment, the motion of the elevator car 16 relative to the magnetic brake pads 44*a* and 44*b* and safety brake 24 may be small. In this embodiment, to reset the safety brake 24 and safety actuation device 40 after the safety brake 24 has been engaged. Minimal alignment is needed between the electromagnetic actuators 42*a*, 42*b* and the magnetic brake pads 44*a* and 44*b*. Therefore in this embodiment, an electrical current is applied to each electromagnetic actuator 42*a*, 42*b* in the opposite direction (opposite to that used to engage) to create an attractive force between the magnetic brake pads 44*a* and 44*b* and the respective electromagnetic actuator 42*a*, 42*b* overcoming the magnetic attraction of the magnetic brake pads 44*a* and 44*b* to the guide rail 20. Advantageously, as with earlier embodiments, it will be appreciated that if one electromagnetic actuator is inoperable, the engagement mechanism 60 employing the four linkages 62*a*-62*d* and pivots 64*a*-64*d* to facilitate both magnetic brake pads 44*a* and 44*b* being lifted off the guide rail 20.

Advantageously with this embodiment and the engagement mechanism comprised of four linkages 62*a*-62*d* and four pivots 64*a*-64*d* permits both the synchronization of engagement of the magnetic brakes 44*a* and 44*b* and the reset or disengagement with either electromagnetic actuator 42*a*, 42*b*. That is, an input from either electromagnetic actuator will set in motion both magnetic brake pads 44*a* and 44*b*. In addition, any differences, commonly referred to as synchronization errors, between the commands to the electromagnetic actuator 42 or the response of the electromagnetic actuator 42*a*, 42*b* will be minimized because the 4-bar configuration of linkages 62*a*-62*d* and the connections to the two magnetic brake pads 44*a* and 44*b*. For example synchronization errors might include any difference between the electromagnetic actuators 42*a*, 42*b* electrical characteristics or response times, differences in the current commands, delay, magnetic differences between the magnetic brake pads 44*a* and 44*b*, friction, fabrication tolerances, and the like. In addition, advantageously, this configuration also ensures that both magnetic brake pads 44*a* and 44*b* are forced to attach to the guide rail 20 on engagement and detach from the guide rail 20 on disengagement, even if one electromagnetic actuator 42*a*, 42*b* becomes inoperative. It should be appreciated that the described embodiment is best suited to placement of the housing 50 and more particularly the placement of the electromagnetic actuators 42*a*, 42*b* such that they are be aligned horizontally. That is, so that the magnetic brake pads 44*a* and 44*b* and the pivots 64*a* and 64*b* align horizontally and likewise the pivots 64*c* and 64*d* align vertically and substantially parallel with the guide rail 20. However, other configurations are possible. A configuration employing electromagnetic actuators and magnetic brake pads 44*a* and 44*b* not horizontally aligned is addressed in another embodiment herein.

Figure 6A:
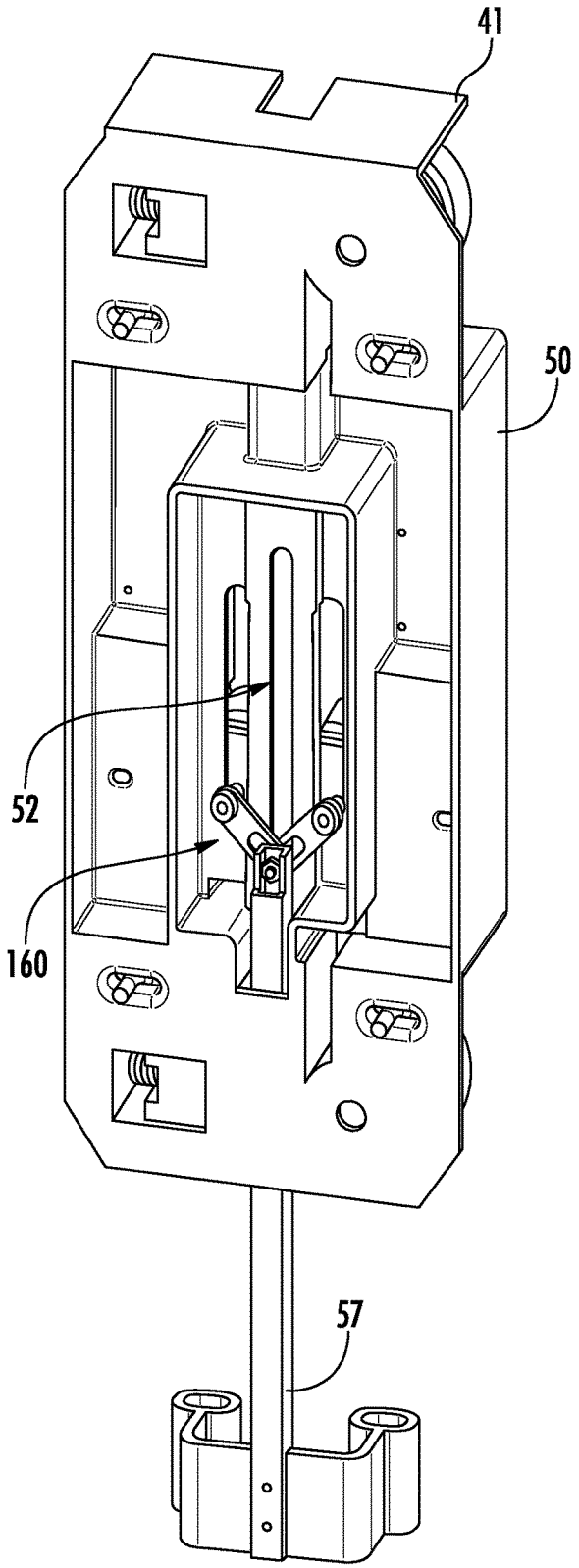
FIG. 6A is a partial perspective view of the electronic safety actuator with an engagement mechanism according to another embodiment of the present disclosure.
Figure 6B:
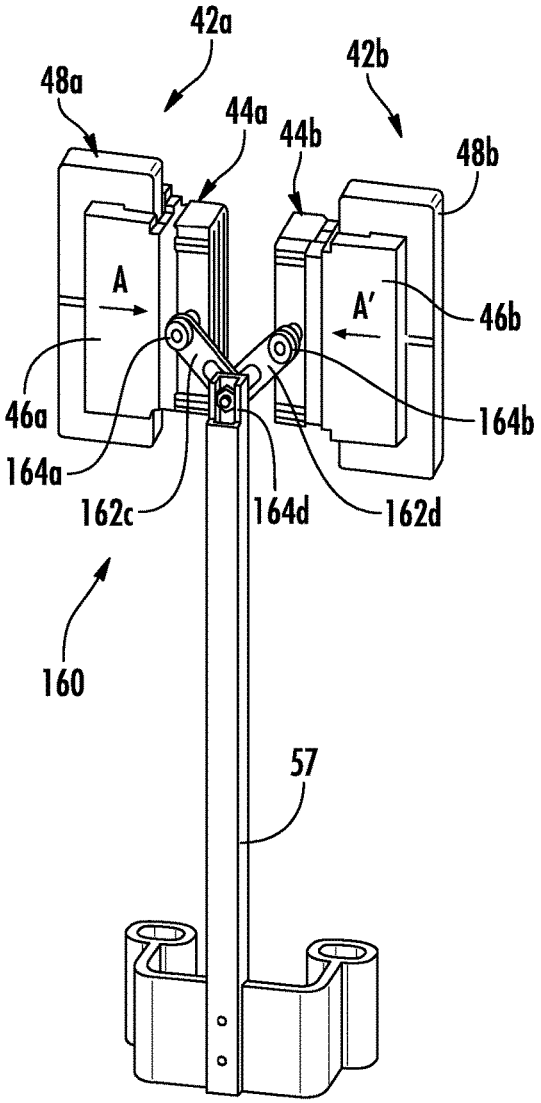
FIG. 6B is a partial perspective view of the electronic safety actuator with an engagement mechanism and electromagnetic actuators according to another embodiment of the present disclosure.

Turning now to FIGS. 6A and 6B as well, where another embodiment of the electronic safety actuator 140 with an alternative engagement mechanism 160 is depicted. In this embodiment, the mechanisms are similar to the previous embodiment with the reference numerals increased by 100. Furthermore, where the reference numerals are unchanged, the function and description is the same as identified above with reference to those particular figures. In an embodiment, the engagement mechanism 160 is comprised of two linkages 162*c* and 162*d* and three pivots 164*a*, 164*b*, and 164*d*. The linkage 162*d* at one end is pivotally attached with pivot 164*b* to magnetic brake pad 44*b*, while its other end is pivotally attached with pivot 164*d* to one end of linkage 162*c* and to linkage 57. The linkage 162*c* at one end is pivotally attached with pivot 164*a* and magnetic brake pad 44*a* and at its other end of linkage 162*d* and linkage 57 at pivot 164*d*. Likewise, the pivot 164*d* rides in a slot 52 or is otherwise constrained in the housing 50 so that any horizontal motion is constrained.

In operation, as described above, when an electromagnetic actuator 42*a*, 42*b* is commanded to actuate the safety brake 24, the magnetic brake pads 44*a* and 44*b* move horizontally toward the guide rail 20, and in turn magnetically attach to the guide rail 20. As the magnetic brake pads 44*a* and 44*b* move, the pivot points 164*a* and 164*b* also move horizontally toward the guide rail 20 as described above. This motion is transferred through the linkages 162*c* and 162*d* causing pivot 164*d* to move vertically in slot 52. The attachment of the magnetic brake pads 44*a* and 44*b* to the guide rail 20 results in the slowing of the magnetic brake pads 44*a* and 44*b* on the guide rail 20 and through the linkages 162*c,d* and pivots 164*d* pulling the linkage 57 relative to motion of the elevator car 16 and thereby engaging the safety brake 24. Advantageously, in this embodiment, the mechanism is simpler with only two linkages 162*c* and 162*d* and three pivots. This embodiment would permit variations in the dimensions and geometry of the linkages 162*c* and 162*d*.

To reset the safety 24 and safety actuation device 40 when employing the engagement mechanism 160 of this embodiment after the safety brake 24 had been engaged operation is similar to above, with some distinctions. Once again, the elevator car 16 is moved upward to align the electromagnetic actuator(s) 42 with the magnetic brake pads 44*a* and 44*b*. Once aligned, electricity is applied to each electromagnetic actuator 42*a*, 42*b* to overcome the magnetic attraction of the magnetic brake pads 44*a* and 44*b* to the guide rail 20 for them to reattach to the respective electromagnetic actuator 42*a*, 42*b*. Advantageously, it will be appreciated that in this embodiment each of the actuators 42*a*, 42*b* is completely independent and the magnetic brake pads 44*a* and 44*b* operate independent of one another. The detachment of the magnetic brake pads 44*a* and 44*b* from the guide rail 20 and reattachment to the respective electromagnetic actuator 42*a*, 42*b* results in the magnetic brake pads 44*a* and 44*b* being returned to the default position and once again ready for reengagement.

In another embodiment, the motion of the elevator car 16 relative to the magnetic brake pads 44*a* and 44*b* and safety brake 24 may be small. In this embodiment, to reset the safety brake 24 and safety actuation device 40 after the safety brake 24 has been engaged. Minimal alignment is needed between the electromagnetic actuators 42*a*, 42*b* and the magnetic brake pads 44*a* and 44*b*. Therefore in this embodiment, an electrical current is applied to each electromagnetic actuator 42*a*, 42*b* in the opposite direction (opposite to that used to engage) to create an attractive force between the magnetic brake pads 44*a* and 44*b* and the respective electromagnetic actuator 42*a*, 42*b* overcoming the magnetic attraction of the magnetic brake pads 44*a* and 44*b* to the guide rail 20.

Figure 7:
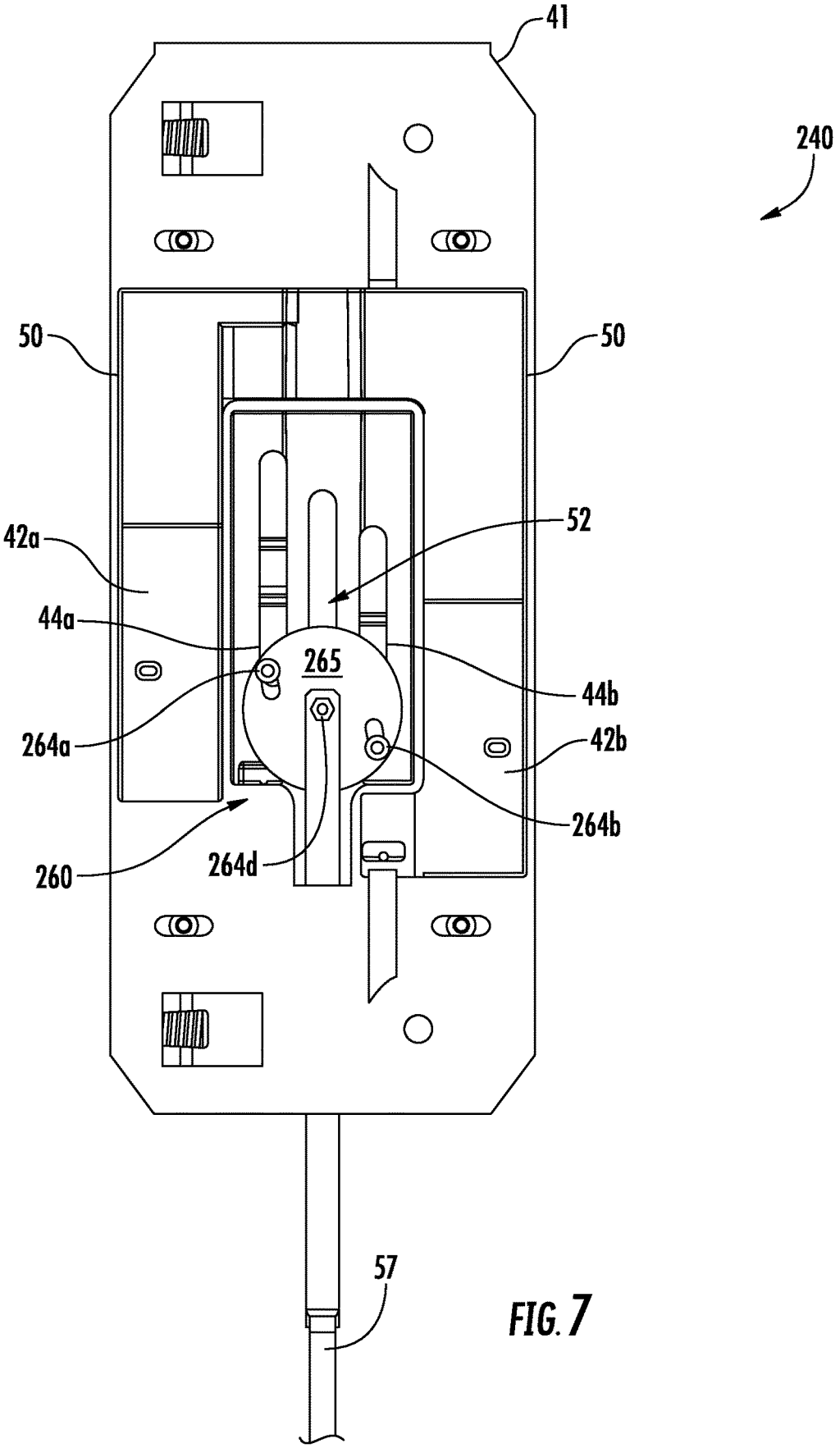
FIG. 7 is a partial view of the electronic safety actuator with an engagement mechanism according to another embodiment of the present disclosure.
Figure 8A:
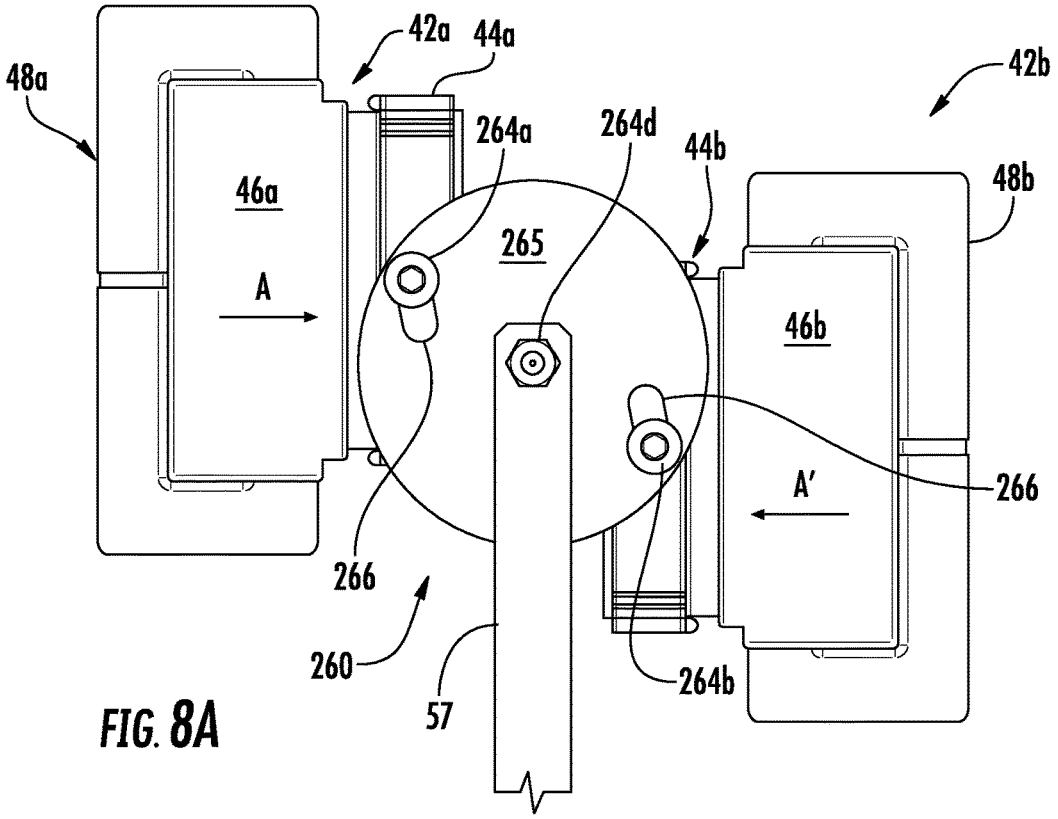
FIG. 8A is an expanded partial view of the electronic safety actuator with an engagement mechanism in a non-engaging position according to another embodiment of the present disclosure.
Figure 8B:
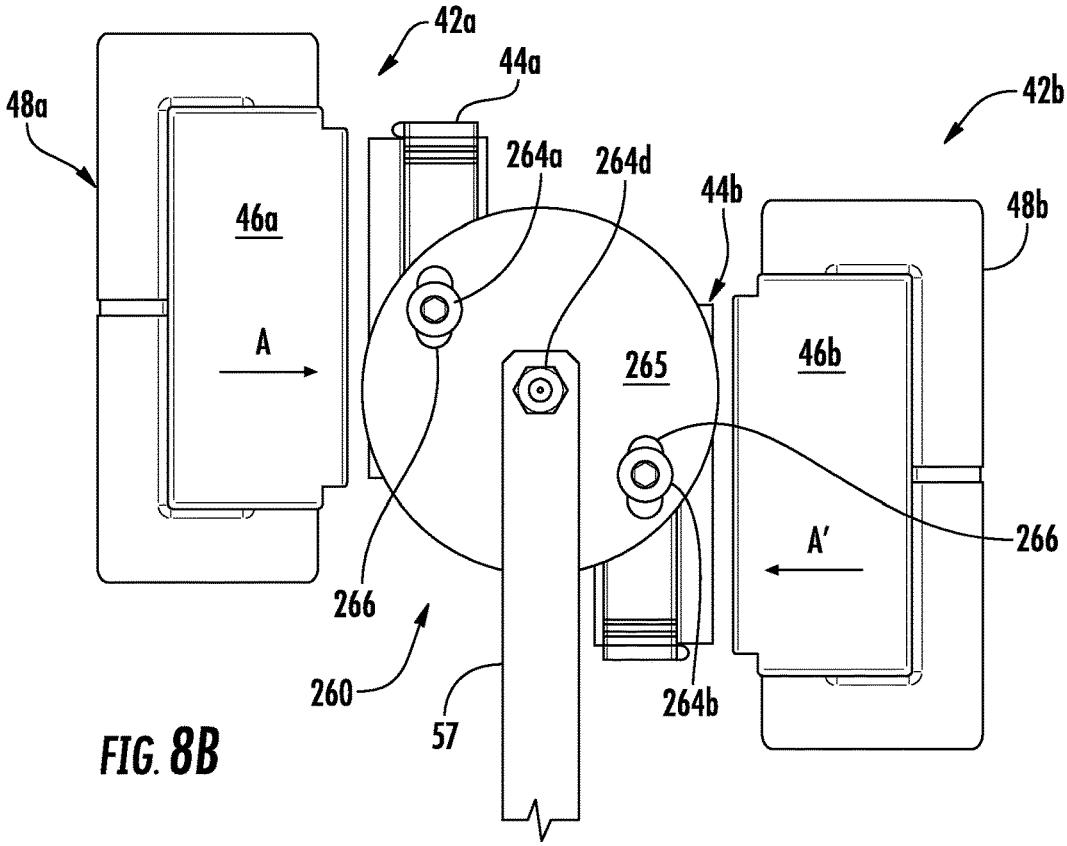
FIG. 8B is an expanded partial view of the electronic safety actuator with an engagement mechanism in an engaging position according to another embodiment of the present disclosure.

Turning now to FIG. 7 where another embodiment of the electronic safety actuator 240 with an alternative engagement mechanism 260 is depicted. In this embodiment, the mechanisms are similar to the previous embodiments with the reference numerals increased by 200. Furthermore, where the reference numerals are unchanged, the function and description is the same as identified above. Turning now to FIGS. 8A and 8B, an expanded view of the engagement mechanism 260 and electromagnetic actuators 42 are depicted. FIG. 8A depicts the magnetic brake pads 44*a* and 44*b* as well as the engagement mechanism 260 in the default or non-engaged position, while FIG. 8B depicts the magnetic brake pads 44*a* and 44*b* as well as the engagement mechanism 260 in the engaged position. In an embodiment, the engagement mechanism 260 is comprised of a plate 265 and three pivots 264*a*, 264*b*, and 264*d*. The plate 265 includes a central pivot 264*d* constrained in the horizontal plane and pivotally fastened to the linkage 57 for transmitting vertical motion and force to the safety brake 24 as with the earlier embodiments. In an embodiment, the plate also includes two slots 266, the slots 266 each including a pivot 264*a* and 264*b* configured to slide and rotate within the slot 266. As with the earlier embodiments the pivot 264*a* and 264*b* are pivotally attached to magnetic brake pads 44*a* and 44*b* respectively and are configured to transfer the motion of the magnetic brake pads 44*a* and 44*b* to the plate 265 causing it to rotate.

In the previous embodiments, the configuration of the safety actuators 42*a*, 42*b* was substantially aligned in the horizontal plane, i.e., in the same horizontal plane and opposing directions. In this embodiment a different scheme is employed where the electromagnetic actuators 42*a*, 42*b* are not aligned horizontally. That is, as depicted in the figure the electromagnetic actuator 42*a* on the left is horizontally above the electromagnetic actuator 42*b* on the right. Furthermore, more particularly, the pivot 264*a* is above the pivot 264*d* and the pivot 264*b* is below the pivot 264*d*, therefore, the magnetic brake pads 44*a* and 44*b* are also not aligned horizontally with magnetic brake pad 44*a* being above magnetic brake pad 44*b*. It will be appreciated that the opposite configuration is equally possible.

Once again, in an embodiment, in operation, when an electromagnetic actuator 42 is commanded to actuate the safety brake 24, the magnetic brake pads 44*a* and 44*b* move horizontally toward the guide rail 20 as described in detail earlier, and in turn magnetically attach to the guide rail 20. As the magnetic brake pads 44*a* and 44*b* move, the pivot points 264*a* and 264*b* also move horizontally toward the guide rail 20. This motion is translated by the plate 265 rotating about the pivot 264*d*. As with the earlier embodiment, the attachment of the magnetic brake pads 44*a* and 44*b* to the guide rail 20 results in the slowing of the magnetic brake pads 44*a* and 44*b* on the guide rail 20 and through the pivot 264*d* pulling the linkage 57 relative to motion of the elevator car 16 and thereby engaging the safety brake 24. It will be appreciated that while the engagement mechanism 260 in this embodiment is described as a plate, it is only for the convenience of description. Any configuration is possible provided it includes the central pivot 264*d* and two slots 266 configured to permit the horizontal motion of the magnetic brake pads 44*a* and 44*b* and can couple force of the magnetic brake pads 44*a* and 44*b* when attached to the guide rail 20 to the linkage 57 to pull in the safety brake 24. For example, while the plate 265 is depicted as circular it could be any shape including a simple rectangle. The only requirement is that the slots and center pivot be collinear and that the slots be long enough to permit the motion of the magnetic brake pads 44*a* and 44*b* to move to the guide rail 20. A disk is depicted for ease of manufacturing. It will be apparent, that the plate 265, and slots 266 needs to be sized as a function of the displacement between the electromagnetic actuators 42*a*, 42*b*. Advantageously, in this embodiment, the use of the plate 265 with the central pivot 264*d* permits synchronization between the inputs of the two electromagnetic actuators 42*a*, 42*b*. That is, an input from either electromagnetic actuator 42 will set in motion both magnetic brake pads 44*a* and 44*b* as described above. The synchronization errors between the commands to the respective electromagnetic actuator(s) 42*a*, 42*b* or their response will be minimized because the linkage of the plate between the two magnetic brake pads 44*a* and 44*b*. In addition, advantageously, this configuration also ensures that both magnetic brake pads 44*a* and 44*b* are forced to attach to the guide rail 20 on engagement even if one electromagnetic actuator 42*a*, 42*b* becomes inoperative.

To reset the safety brake 24 and safety actuation device 40 after the safety brake 24 has been engaged, the elevator car 16 is moved upward to align the respective electromagnetic actuator 42 with the magnetic brake pads 44*a* and 44*b* as described earlier. Once aligned, electrical current is applied to each electromagnetic actuator 42*a*, 42*b* in the opposite direction (opposite to that used to engage) to create an attractive force between the magnetic brake pads 44*a* and 44*b* and the respective electromagnetic actuator 42*a*, 42*b* overcoming the magnetic attraction of the magnetic brake pads 44*a* and 44*b* to the guide rail 20. Advantageously, it will be appreciated that if one electromagnetic actuator is inoperable, the engagement mechanism 260 employing plate 265 and pivots 264*a*, 264*b*, and 264*d* to cause the both magnetic brakes 44*a* and 44*b* to be lifted off the guide rail 20. In particular, if, when the electromagnetic actuator 42*a*, 42*b* in this example on the right is commanded to reset, the magnetic brake 44*b* moves horizontally away from the guide rail 20 opposite direction A'. As the magnetic brake 44*b* moves, the pivot point 264*b* also moves horizontally away from the guide rail 20. This motion is transferred through the rotation of the plate 265 about pivot 264*d* causing pivot 264*a* to move to the left away from the guide rail 20. The detachment of the magnetic brakes 44*a* and 44*b* from the guide rail 20 and reattachment to the respective electromagnetic actuator 42*a*, 42*b* results in the magnetic brakes 44*a* and 44*b* being returned to the default position and once again ready for reengagement.

In another embodiment, the motion of the elevator car 16 relative to the magnetic brake pads 44*a* and 44*b* and safety brake 24 may be small. In this embodiment, to reset the safety brake 24 and safety actuation device 40 after the safety brake 24 has been engaged. Minimal alignment is needed between the electromagnetic actuators 42*a*, 42*b* and the magnetic brake pads 44*a* and 44*b*. Therefore in this embodiment, an electrical current is applied to each electromagnetic actuator 42*a*, 42*b* in the opposite direction (opposite to that used to engage) to create an attractive force between the magnetic brake pads 44*a* and 44*b* and the respective electromagnetic actuator 42*a*, 42*b* overcoming the magnetic attraction of the magnetic brake pads 44*a* and 44*b* to the guide rail 20. Advantageously, as with earlier embodiments, it will be appreciated that if one electromagnetic actuator is inoperable, the engagement mechanism 260 employing the plate 265 with slots 266 and pivots 264*a*, 264*b*, and 264*d* facilitate both magnetic brake pads 44*a* and 44*b* being lifted off the guide rail 20.

Advantageously with this embodiment and the engagement mechanism comprised of a simple plate 265 with two slots 266 and the three pivots 264*a*, 264*b*, and 264*d* permits both the synchronization of engagement of the magnetic brakes 44*a* and 44*b* and the reset or disengagement with either electromagnetic actuator 42*a*, 42*b*. This configuration requires that the housing 50 and more particularly the placement of the electromagnetic actuators 42*a*, 42*b* be displaced in different horizontal plane. That is, so that the magnetic brakes 44*a* and 44*b* and the pivots 264*a* and 264*b* are not aligned horizontally.

Once again, it will be appreciated that while the engagement and disengagement of the safety actuation device 40 is described with respect to employing electromagnetic actuators 42*a* and 42*b*, other forms of actuation are possible and envisioned. For example, a mechanical mechanism such as springs, latches, control arms, pneumatics and the like could be used to move the magnetic brake pads 44*a*, 44*b* between the nonengaging and engaging positions. In particular, for example a spring with a release mechanism could be used to propel the magnetic brake pads 44*a*, 44*b* from the nonengaging position, to an engaging position where they would adhere to the guide rail 20.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A selectively operable braking device for an elevator system including a car and a guide rail, comprising:

a safety brake disposed on the car and adapted to be wedged against the guide rail when moved from a non-braking state into a braking state;

an engagement mechanism having an engaging position and a nonengaging position, the engagement mechanism operably coupled to the safety brake and configured to move the safety brake between the non-braking state and braking state when the engagement mechanism moves between the nonengaging position and the engaging position; and a first magnetic brake pad and a second magnetic brake pad, the first magnetic brake pad and the second magnetic brake pad disposed in opposing directions adjacent to the guide rail and configured to move between the non-engaging position and the engaging position, the first magnetic brake pad and the second magnetic brake pad operably coupled to the engagement mechanism, wherein the engagement mechanism is configured such that movement of the first magnetic brake pad into the engaging position causes movement of the second magnetic brake pad into the engaging position, the first magnetic brake pad and the second magnetic brake pad being magnetically attracted to the guide rail in the engaging position.

2. The braking device of claim 1 further including a first electromagnetic actuator and a second electromagnetic actuator, wherein the first electromagnetic actuator is configured to electromagnetically move the first magnetic brake pad between the non-engaging position and engaging position and the second electromagnetic actuator configured to electromagnetically move the second magnetic brake pad between the non-engaging position and engaging position.

3. The braking device of claim 2, wherein the elevator car is moved to align the first magnetic brake pad and the second magnetic brake pad with the first electromagnetic actuator and second electromagnetic actuator respectively to reset the safety brake from the braking state to the non-braking state, wherein the engagement mechanism is moved between the engaging position to the non-engaging position.

4. The braking device of claim 2 wherein at least one of the first electromagnetic actuator and the second electromagnetic actuator is in operable communication with a controller, the controller configured to control the electricity supplied to the at least one of the first electromagnetic actuator and the second electromagnetic actuator.

5. The braking device of claim 4, wherein the at least one of the first electromagnetic actuator and the second electromagnetic actuator is configured to move the first magnetic brake pad and second magnetic brake pad into the engaging position upon at least one of a reduction, an elimination, and an application of the electricity supplied by the controller.

6. The braking device of claim 4, wherein the at least one of the first electromagnetic actuator and the second electromagnetic actuator is configured to return the first magnetic brake pad and the second magnetic brake pad into the non-engaging position upon reversal of the electricity supplied by the controller.

7. The braking device of claim 1 wherein the engagement mechanism is configured to synchronize the movement of the first magnetic brake pad and the second magnetic brake pad between the non-engaging position and the engaging position.

8. The braking device of claim 1 wherein the engagement mechanism is a four-bar linkage.

9. The braking device of claim 8 wherein the four-bar linkage is comprised of four substantially equally sized links operably connected by pivots, wherein two opposing pivots are each attached to at least one of the first magnetic brake pad and the second magnetic brake pad and at least one of a third pivot and fourth pivot pivots are horizontally constrained and operably attached to the safety brake, wherein movement of at least one of the first magnetic brake pad and the second magnetic brake pad from the non-engaging position to the engaging position, and thereby the attached two opposing pivots, operate at least one of the third pivot and the forth pivot to move to cause the safety brake to move from the non-braking state into the braking state.

10. The braking device of claim 1 wherein the engagement mechanism is a plate.

11. The braking device of claim 10 wherein plate is comprised of three collinear pivots with two opposing pivots equidistant from a central pivot, wherein two opposing pivots operating in slots in the plate are each attached to one of the first magnetic brake pad and the second magnetic brake pads respectively, and a third pivot is are horizontally constrained and operably attached to the safety brake, wherein movement of at least one of the first magnetic brake pads and second magnetic brake pad from the non-engaging position to the engaging position, and thereby the attached two opposing pivots, causes plate to rotate and the third pivot to move to cause the safety brake to move from the non-braking state into the braking state.

12. A selectively operable braking device for an elevator system including a car and a guide rail, comprising:

a safety brake disposed on the car and adapted to be wedged against the guide rail when moved from a non-braking state into a braking state; and a magnetic brake pad operably coupled an engagement mechanism and disposed adjacent to the guide rail, the magnetic brake pad configured to move between an non-engaging position and an engaging position, the magnetic brake pad, when in the engaging position, causing the engagement mechanism to move the safety brake from the non-braking state into the braking state;

an electromagnetic actuator, wherein the electromagnetic actuator is configured to hold the magnetic brake pad in the non-engaging position;

wherein the elevator car is moved to align the magnetic brake pad with the electromagnetic actuator to reset the safety brake from the braking state to the non-braking state, wherein the engagement mechanism is moved between the engaging position to the non-engaging position.

13. The braking device of claim 12 wherein the electromagnetic actuator is in operable communication with a controller, the controller configured to control the electricity supplied to the electromagnetic actuator.

14. The braking device of claim 13, wherein the electromagnetic actuator is configured to move the magnetic brake pad into the engaging position upon at least one of the application of, the reduction of, and the elimination of electricity supplied by the controller.

15. The braking device of claim 13, wherein the electromagnetic actuator is configured to return the magnetic brake pad into the non-engaging position upon reversal of the electricity supplied by the controller.

16. The braking device of claim 12 wherein the engagement mechanism is configured to ensure the movement of a second magnetic brake pad between a non-engaging position and an engaging position.

17. The braking device of claim 12 wherein the engagement mechanism is a two-bar linkage.

18. An elevator system comprising:

a hoistway;

a guide rail disposed in the hoistway;

a car operably coupled to the guide rail by a car frame for upward and downward travel in the hoistway;

a safety brake disposed on the car and adapted to be wedged against the guide rail when moved from a non-braking state into a braking state;

an engagement mechanism operably coupled to the safety brake and configured to move the safety brake between the non-braking state and braking state; and a first magnetic brake pad and a second magnetic brake pad, the first magnetic brake pad and the second magnetic brake pad disposed in opposing directions adjacent to the guide rail and configured to move between the non-engaging position and the engaging position, the first magnetic brake pad and the second magnetic brake pad operably coupled to the engagement mechanism, wherein the engagement mechanism is configured such that movement of the first magnetic brake pad into the engaging position causes movement of the second magnetic brake pad into the engaging position, the first magnetic brake pad and the second magnetic brake pad being magnetically attracted to the guide rail in the engaging position.

* * * * *